US008733265B2

(12) United States Patent
Vandenworm

(10) Patent No.: US 8,733,265 B2
(45) Date of Patent: May 27, 2014

(54) OFFSHORE BUOYANT DRILLING, PRODUCTION, STORAGE AND OFFLOADING STRUCTURE

(71) Applicant: SSP Technologies, Inc., Grand Cayman (KY)

(72) Inventor: Nicolaas J. Vandenworm, Houston, TX (US)

(73) Assignee: SSP Technologies, Inc., Grand Cayman (KY)

( * ) Notice: Subject to any disclaimer, the term of this patent is extended or adjusted under 35 U.S.C. 154(b) by 0 days.

(21) Appl. No.: 13/950,221

(22) Filed: Jul. 24, 2013

(65) Prior Publication Data

US 2013/0305976 A1 Nov. 21, 2013

Related U.S. Application Data

(63) Continuation of application No. 13/569,096, filed on Aug. 7, 2012, now Pat. No. 8,544,402, which is a continuation of application No. 12/914,709, filed on Oct. 28, 2010, now Pat. No. 8,251,003.

(60) Provisional application No. 61/262,533, filed on Nov. 18, 2009, provisional application No. 61/259,201, filed on Nov. 8, 2009.

(51) Int. Cl.
*B63B 35/44* (2006.01)

(52) U.S. Cl.
USPC ..... 114/264; 114/125; 114/230.2

(58) Field of Classification Search
USPC ..... 114/264, 230.1, 121, 125
See application file for complete search history.

(56) References Cited

U.S. PATENT DOCUMENTS

| | | | |
|---|---|---|---|
| 2,771,617 | A | 11/1956 | Brackx |
| 3,074,082 | A | 1/1963 | Griebe |
| 3,822,663 | A | 7/1974 | Boschen, Jr. |
| 3,941,060 | A | 3/1976 | Morsbach |
| 4,048,943 | A | 9/1977 | Gerwick, Jr. |
| 4,108,102 | A | 8/1978 | Lindstrom |
| 4,735,167 | A | 4/1988 | White et al. |
| 4,984,523 | A | 1/1991 | Dehne et al. |
| 5,065,687 | A | 11/1991 | Hampton |
| 5,595,121 | A | 1/1997 | Elliott et al. |
| 5,702,206 | A | 12/1997 | Quenan et al. |

(Continued)

FOREIGN PATENT DOCUMENTS

EP 1178922 B1 2/2002

*Primary Examiner* — Stephen Avila
(74) *Attorney, Agent, or Firm* — Buskop Law Group, PC; Wendy Buskop

(57) ABSTRACT

An offshore structure having a hull, an upper vertical wall, an upper inwardly-tapered wall disposed below the upper vertical wall, a lower outwardly-tapered wall disposed below the upper sloped wall, and a lower vertical wall disposed below the lower sloped wall. The upper and lower sloped walls produce significant heave damping in response to heavy wave action. A heavy slurry of hematite and water ballast is added to the lower and outermost portions of the hull to lower the center of gravity below the center of buoyancy. The offshore structure provides one or more movable hawser connections that allow a tanker vessel to moor directly to the offshore structure during offloading rather than mooring to a separate buoy at some distance from the offshore storage structure. The movable hawser connection includes an arcuate rail with a movable trolley that provides a hawser connection point that allows vessel weathervaning.

16 Claims, 8 Drawing Sheets

(56) References Cited

U.S. PATENT DOCUMENTS

| | | | |
|---|---|---|---|
| 6,340,272 | B1 | 1/2002 | Runge et al. |
| 6,340,273 | B1 | 1/2002 | Hull |
| 6,371,697 | B2 | 4/2002 | Huang et al. |
| 6,431,107 | B1 | 8/2002 | Byle |
| 6,739,804 | B1 | 5/2004 | Haun |
| 6,761,508 | B1 | 7/2004 | Haun |
| 6,782,950 | B2 | 8/2004 | Amin et al. |
| 6,827,160 | B2 | 12/2004 | Blair et al. |
| 6,857,373 | B2 | 2/2005 | Checketts et al. |
| 6,942,427 | B1 | 9/2005 | Srinivasan |
| 6,945,736 | B2 | 9/2005 | Smedal et al. |
| 6,976,433 | B1 | 12/2005 | Oma et al. |
| 7,004,076 | B2 | 2/2006 | Traubenkraut et al. |
| 7,086,810 | B2 | 8/2006 | Masetti et al. |
| 7,431,622 | B2 | 10/2008 | Haun |
| 7,500,787 | B2 | 3/2009 | Cioceanu |
| 7,958,835 | B2 | 6/2011 | Srinivasan |
| 8,251,003 | B2 | 8/2012 | Vandenworm |
| 8,544,402 | B2 * | 10/2013 | Vandenworm ..... 114/230.1 |
| 2004/0240946 | A1 | 12/2004 | Haun |
| 2004/0258484 | A1 | 12/2004 | Haun |
| 2005/0212285 | A1 | 9/2005 | Haun |
| 2005/0277344 | A1 | 12/2005 | Haun |
| 2009/0078632 | A1 | 3/2009 | Gallo et al. |
| 2009/0126616 | A1 | 5/2009 | Srinivasan |
| 2009/0158988 | A1 | 6/2009 | Ding et al. |

* cited by examiner

OFFSHORE BUOYANT DRILLING, PRODUCTION, STORAGE AND OFFLOADING STRUCTURE

CROSS REFERENCE TO RELATED APPLICATIONS

This application is a Continuation of U.S. patent application Ser. No. 13/569,096 filed on Aug. 7, 2012 now U.S. Pat. No. 8,544,402 issued Oct. 1, 2013, entitled: "OFFSHORE BUOYANT DRILLING, PRODUCTION, STORAGE AND OFFLOADING STRUCTURE," which is a continuation of U.S. patent application Ser. No. 12/914,709 filed on Oct. 28, 2010 now U.S. Pat. No. 8,251,003 issued Aug. 28, 2012, which is based upon U.S. Provisional Patent Application Ser. No. 61/259,201 filed on Nov. 8, 2009 and U.S. Provisional Patent Application Ser. No. 61/262,533 filed on Nov. 18, 2009. These references are hereby incorporated in their entirety.

FIELD

The present embodiments generally relate to offshore buoyant vessels, platforms, caissons, buoys, spars, or other structures used for petrochemical storage and tanker loading. In particular, the present invention relates to hull and offloading system designs for floating storage and offloading (FSO), floating production, storage and offloading (FPSO) or floating drilling, production, storage and offloading (FDPSO) structures, floating production/process structures (FPS), or floating drilling structures (FDS).

BACKGROUND

Offshore buoyant structures for oil and gas production, storage and offloading are known in the art. Offshore production structures, which may be vessels, platforms, caissons, buoys, or spars, for example, each typically, include a buoyant hull that supports a superstructure. The hull includes internal compartmentalization for storing hydrocarbon products, and the superstructure provides drilling and production equipment, crew living quarters, and the like.

A floating structure is subject to environmental forces of wind, waves, ice, tides, and current. These environmental forces result in accelerations, displacements and oscillatory motions of the structure. The response of a floating structure to such environmental forces is affected not only by its hull design and superstructure, but also by its mooring system and any appendages. Accordingly, a floating structure has several design requirements: Adequate reserve buoyancy to safely support the weight of the superstructure and payload, stability under all conditions, and good seakeeping characteristics. With respect to the good seakeeping requirement, the ability to reduce vertical heave is very desirable. Heave motions can create alternating tension in mooring systems and compression forces in the production risers, which can cause fatigue and failure. Large heave motions increase riser stroke and require more complex and costly riser tensioning and heave compensating systems.

The seakeeping characteristics of a buoyant structure are influenced by a number of factors, including the waterplane area, the hull profile, and the natural period of motion of the floating structure. It is very desirable that the natural period of the floating structure be either significantly greater than or significantly less than the wave periods of the sea in which the structure is located, so as to substantially decouple the motion of the structure from the wave motion.

Vessel design involves balancing competing factors to arrive at an optimal solution for a given set of factors. Cost, constructability, survivability, utility, and installation concerns are among many considerations in vessel design. Design parameters of the floating structure include the draft, the waterplane area, the draft rate-of-change, the location of the center of gravity ("CG"), the location of the center of buoyancy ("CB"), the metacentric height ("GM"), the sail area, and the total mass. The total mass includes added mass—i.e., the mass of the water around the hull of the floating structure that is forced to move as the floating structure moves. Appendages connected to the structure hull for increasing added mass are a cost effective way to fine tune structure response and performance characteristics when subjected to the environmental forces.

Several general naval architecture rules apply to the design of an offshore vessel: The waterplane area is directly proportional to induced heave force. A structure that is symmetric about a vertical axis is generally less subject to yaw forces. As the size of the vertical hull profile in the wave zone increases, wave-induced lateral surge forces also increase. A floating structure may be modeled as a spring with a natural period of motion in the heave and surge directions. The natural period of motion in a particular direction is inversely proportional to the stiffness of the structure in that direction. As the total mass (including added mass) of the structure increases, the natural periods of motion of the structure become longer.

One method for providing stability is by mooring the structure with vertical tendons under tension, such as in tension leg platforms. Such platforms are advantageous, because they have the added benefit of being substantially heave restrained. However, tension leg platforms are costly structures and, accordingly, are not feasible for use in all situations.

Self-stability (i.e., stability not dependent on the mooring system) may be achieved by creating a large waterplane area. As the structure pitches and rolls, the center of buoyancy of the submerged hull shifts to provide a righting moment. Although the center of gravity may be above the center of buoyancy, the structure can nevertheless remain stable under relatively large angles of heel. However, the heave seakeeping characteristics of a large waterplane area in the wave zone are generally undesirable.

Inherent self-stability is provided when the center of gravity is located below the center of buoyancy. The combined weight of the superstructure, hull, payload, ballast and other elements may be arranged to lower the center of gravity, but such an arrangement may be difficult to achieve. One method to lower the center of gravity is the addition of fixed ballast below the center of buoyancy to counterbalance the weight of the superstructure and payload. Structural fixed ballast such as pig iron, iron ore, and concrete, are placed within or attached to the hull structure. The advantage of such a ballast arrangement is that stability may be achieved without adverse effect on seakeeping performance due to a large waterplane area.

Self-stable structures have the advantage of stability independent of the function of the mooring system. Although the heave seakeeping characteristics of self-stabilizing floating structures are generally inferior to those of tendon-based platforms, self-stabilizing structures may nonetheless be preferable in many situations due to higher costs of tendon-based structures.

Prior art floating structures have been developed with a variety of designs for buoyancy, stability, and seakeeping characteristics.

Various spar buoy designs as examples of inherently stable floating structures in which the center of gravity ("CG") is disposed below the center of buoyancy ("CB"). Spar buoy hulls are elongated, typically extending more than six hundred feet below the water surface when installed. The longitudinal dimension of the hull must be great enough to provide mass such that the heave natural period is long, thereby reducing wave-induced heave. However, due to the large size of the spar hull, fabrication, transportation and installation costs are increased. It is desirable to provide a structure with integrated superstructure that may be fabricated quayside for reduced costs, yet which still is inherently stable due to a CG located below the CB.

Offshore platform that employs a retractable center column, wherein the center column is raised above the keel level to allow the platform to be pulled through shallow waters en route to a deep water installation site. At the installation site, the center column is lowered to extend below the keel level to improve vessel stability by lowering the CG. The center column also provides pitch damping for the structure. However, the retractable center column adds complexity and cost to the construction of the platform.

Other offshore system hull designs are known in the art. For instance, some offshore system hull designs have an octagonal hull structure with sharp corners and steeply sloped sides to cut and break ice for arctic operations of a vessel. Unlike most conventional offshore structures, which are designed for reduced motions, some structures are designed to induce heave, roll, pitch and surge motions to accomplish ice cutting.

Other designs disclose a drilling and production platform with a cylindrical hull. This structure has a CG located above the CB and therefore relies on a large waterplane area for stability, with a concomitant diminished heave seakeeping characteristic. Although, the structure has a circumferential recess formed about the hull near the keel for pitch and roll damping, the location and profile of such a recess has little effect in dampening heave.

It is believed that none of the offshore structures of prior art are characterized by all of the following advantageous attributes: symmetry of the hull about a vertical axis; the CG located below the CB for inherent stability without the requirement for complex retractable columns or the like, exceptional heave damping characteristics without the requirement for mooring with vertical tendons, and the ability for quayside integration of the superstructure and "right-side-up" transit to the installation site, including the capability for transit through shallow waters. A buoyant offshore structure possessing all of these characteristic is desirable.

Further, there is a need for improvement in offloading systems for transferring petroleum products from an offshore production and/or storage structure to a tanker ship. According to the prior art, as part of an offloading system, a small catenary anchor leg mooring (CALM) buoy is typically anchored near a storage structure. The CALM buoy provides the ability for a tanker to freely weathervane about the buoy during the product transfer process.

For example, an example of a buoy in an offloading system, wherein the buoy is anchored to the seabed so as to provide a minimum weathervane distance from the nearby storage structure. One or more underwater mooring tethers or bridles attach the CALM buoy to the storage structure and carry a product transfer hose therebetween. A tanker connects to the CALM buoy such that a hose is extended from the tanker to the CALM buoy for receiving product from the storage structure via the CALM buoy.

It would be advantageous for an offshore production and/or storage structure to provide the capability to receive a tanker or other vessel and have that vessel moor directly thereto with the ability for the vessel to freely weathervane about the offshore structure while taking on product. Such an arrangement obviates the need for a separate buoy and provides enhanced safety and reduced installation, operating and maintenance costs. The present embodiments meet these needs.

BRIEF DESCRIPTION OF THE DRAWINGS

The detailed description will be better understood in conjunction with the accompanying drawings as follows.

Figure 1:
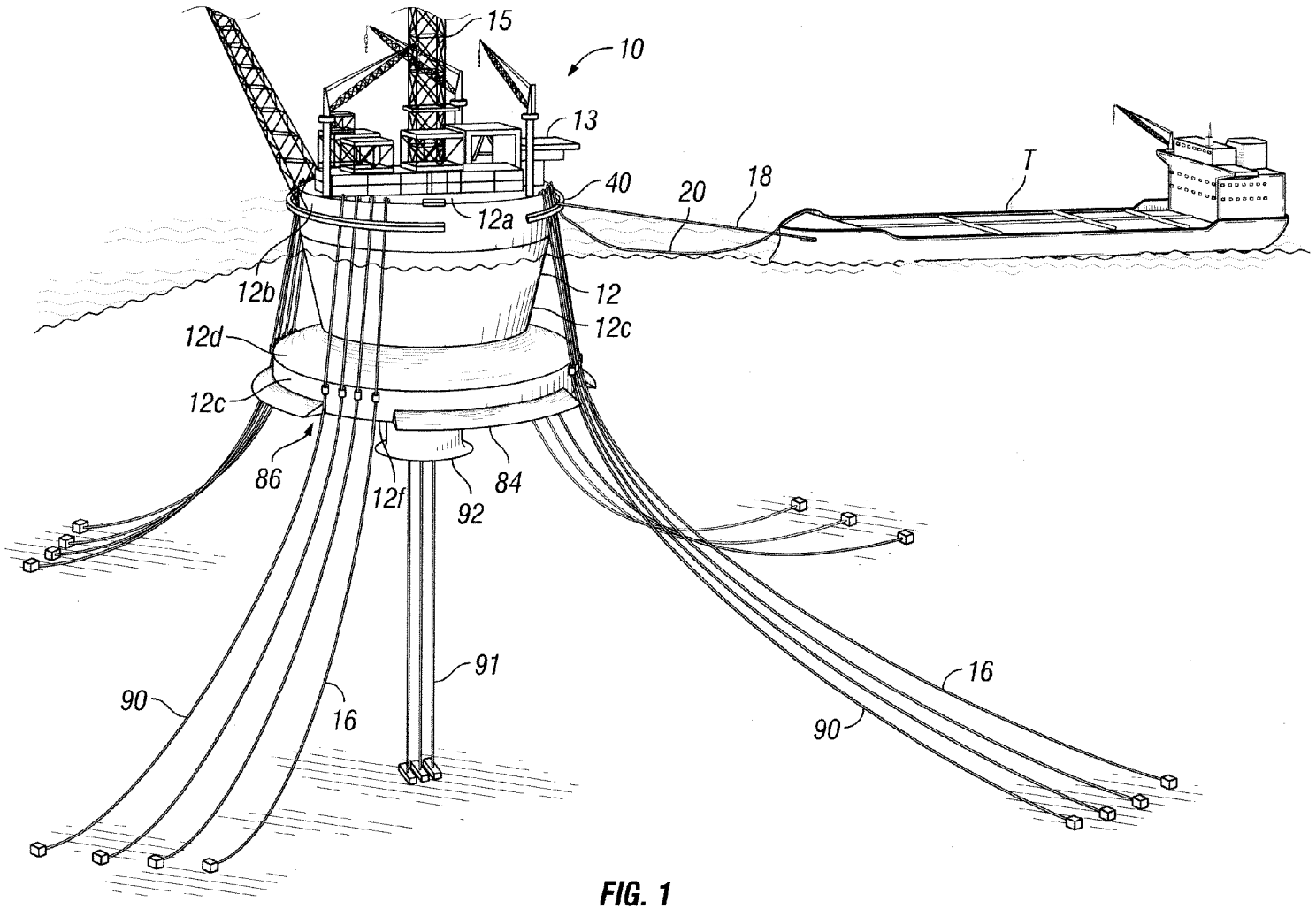
FIG. 1 is a perspective view of a buoyant offshore storage structure moored to the seabed and carrying production risers according to an embodiment of the invention, shown with a superstructure carried by the storage structure to support drilling operations and with a tanker vessel moored thereto via a movable hawser system for transferring hydrocarbon product.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to offshore buoyant vessels, platforms, caissons, buoys, spars, or other structures used for petrochemical storage and tanker loading A primary object of the invention is to provide a buoyant offshore structure characterized by all of the following advantageous attributes: symmetry of the hull about a vertical axis; the center of gravity located below the center of buoyancy for inherent stability without the requirement for complex retractable columns or the like, exceptional heave damping characteristics without the requirement for mooring with vertical tendons, and a design that provides for quayside integration of the superstructure and "right-side-up" transit to the installation site, including the capability to transit through shallow waters.

Another object of the invention is to provide a method and apparatus for offshore drilling, production, storage and offloading from a single cost-effective buoyant structure.

Another object of the invention is to provide a method and apparatus for offshore drilling, production, storage and offloading that performs the activities of a semi-submersible platform, a tension leg platform, a spar platform, and a floating production, storage and offloading vessel in one multifunctional structure.

Another object of the invention is to provide a method and apparatus for offshore drilling, production, storage and offloading that provides improved pitch, roll and heave resistance.

Another object of the invention is to provide a method and offshore apparatus for storing and offloading oil and gas that eliminates the requirement for a separate buoy for mooring a transport tanker vessel during product transfer.

Another object of the invention is to provide a method and offshore apparatus for storing and offloading oil and gas that eliminates the requirement for a turret.

Another object of the invention is to provide a method and apparatus for offshore drilling, production, storage and offloading that uses a modular drilling package that can be removed and used elsewhere when production wells have been drilled.

Another object of the invention is to provide a simplified method and apparatus for offshore drilling, production, storage and offloading that provides for fine tuning of the overall system response to meet specific operating requirements and regional environmental conditions.

Another object of the invention is to provide a method and apparatus for offshore drilling, production, storage and offloading that provides for single or tandem offloading.

Another object of the invention is to provide a method and apparatus for offshore drilling, production, storage and offloading that provides a large storage capacity.

Another object of the invention is to provide a method and apparatus for offshore drilling, production, storage and offloading that accommodates drilling marine risers and dry tree solutions.

Another object of the invention is to provide a method and apparatus for offshore drilling, production, storage and offloading that can be constructed without the need for a graving dock, thereby allowing construction in virtually any fabrication yard.

Another object of the invention is to provide a method and apparatus for offshore drilling, production, storage and offloading that is easily scalable.

The objects described above and other advantages and features of the invention are incorporated, in embodiments, in an offshore structure having a hull symmetric about a vertical axis with an upper vertical side wall extending downwardly from the main deck, an upper inwardly tapered side wall disposed below the upper vertical wall, a lower outwardly tapered side wall disposed below the upper sloped side wall, and a lower vertical side wall disposed below the lower sloped side wall. The hull platform may have circular or polygonal cross-section.

The upper inward-tapering side wall slopes at an angle with respect to the vessel vertical axis from 10 degrees to 15 degrees. The lower outward tapering side wall slopes at an angle with respect to the vessel vertical axis from 55 degrees to 65 degrees. The upper and lower tapered side walls cooperate to produce a significant amount of radiation damping resulting in almost no heave amplification for any wave period. Optional fin-shaped appendages can be provided near the keel level for creating added mass to further reduce and fine tune the heave.

The center of gravity of the offshore vessel according to the invention is located below its center of buoyancy in order to provide inherent stability. The addition of ballast to the lower and outermost portions of the hull is used to lower the CG for various superstructure configurations and payloads to be carried by the hull. A heavy slurry of hematite or other heavy material and water may be used, providing the advantages of high density structural ballast with the ease and flexibility of removal by pumping, should the need arise. The ballasting creates large righting moments and increases the natural period of the structure to above the period of the most common waves, thereby limiting wave-induced acceleration in all degrees of freedom.

The height (h) of the hull is limited to a dimension that allows the structure to be assembled onshore or quayside using conventional shipbuilding methods and then towed upright to an offshore location.

The offshore structure provides one or more movable hawser connections that allow a tanker vessel to moor directly to the offshore structure during offloading rather than mooring to a separate buoy at some distance from the offshore storage structure. The movable hawser connection includes an arcuate track or rail. A trolley rides on the rail and provides a movable mooring padeye or hard point to which a mooring hawser connects and moors a tanker vessel.

Turning now to the Figures, FIG. 1 illustrates a buoyant structure 10 for production and/or storage of hydrocarbons from subsea wells according to one or more embodiments.

A buoyant structure 10 includes a hull 12, which can carry a superstructure 13 thereon. The superstructure 13 can include a diverse collection of equipment and structures, such as living quarters for a crew, equipment storage, and a myriad of other structures, systems, and equipment, depending on the type of offshore operation to be performed. For example, the superstructure 13 for drilling a well can include a derrick 15 for drilling, running pipe and casing, and related operations.

Figure 3:
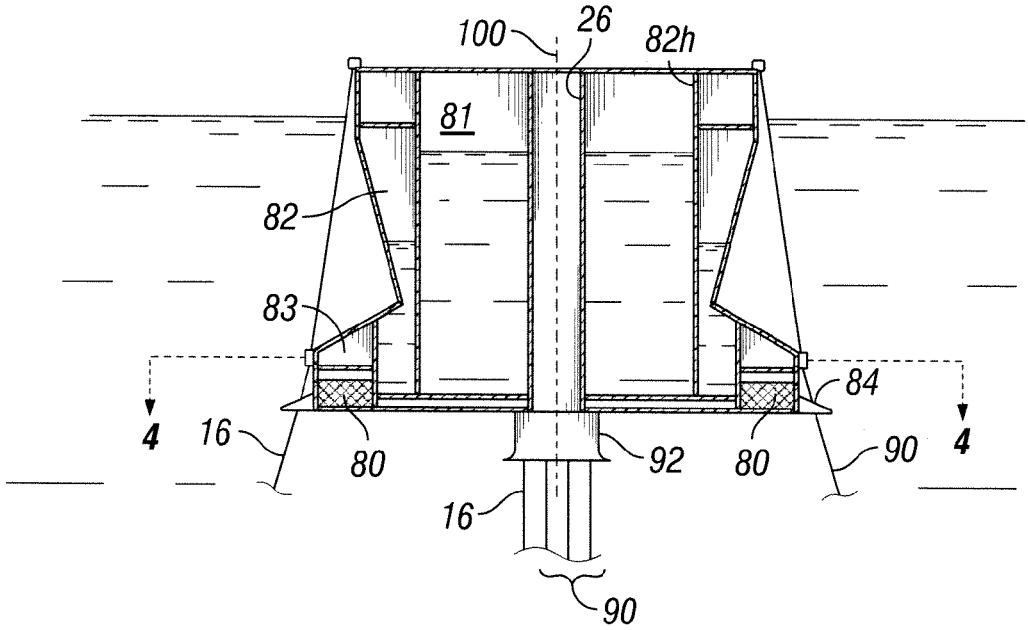
FIG. 3 is a view of the hull of the offshore storage structure of FIG. 1 in vertical cross-section along its longitudinal axis, showing an optional moon pool, fins mounted at or near keel level for fine tuning the dynamic response of the structure by controlling added mass, and internal compartmentalization including ring-shaped lower tanks ballasted with a hematite slurry, according to an embodiment of the invention.

The hull 12 is moored to the seafloor by a number of anchor lines 16. Catenary risers 90 can radially extend between the buoyant structure 10 and subsea wells. Alternatively or additionally, vertical risers 91 can extend between the seafloor and the hull 12. At keel level, a multifunctional center frame 86 can be provided to laterally and or vertically support one or more catenary or vertical risers 90, 91. The multifunctional center frame 86 can be integrated with the hull 12 during construction of the hull, or it may be integrated in the center well of a moon pool 26, which is shown in FIG. 3, and deployed after the buoyant structure 10 is located at the installation site. The axial length of the multifunctional center frame 86 is application dependent. The lower end of the multifunctional center frame 86 is ideally flared outwardly for use as a riser landing porch. The multifunctional center frame 86 can be used in combination with the center well moon pool 26, but a center well is not required. The multifunctional center frame 86 can be modified with minimal effect on the design of the hull 12 and allows for flexibility in topsides layout.

A tanker vessel (T) is moored to the buoyant structure 10 at a movable hawser connection assembly 40 via a hawser 18. The movable hawser connection assembly 40 includes an arcuate rail that carries a trolley thereon thus providing a movable hard point to which the hawser 18 connects. The movable hawser connection assembly 40 allows the tanker vessel (T) to freely weathervane about at least a circumferential portion of the buoyant structure 10. A product transfer hose 20 connects the buoyant structure 10 to tanker vessel (T) for transferring hydrocarbon products.

In embodiments, the hull 12 of the buoyant structure 10 has a generally horizontal main deck 12*a*, an upper vertical wall section 12*b* extending downwardly from the main deck 12*a*, an upper tapered wall section 12*c* extending downwardly from the upper vertical wall section 12*b* and tapering inwardly, a the lower tapered wall section 12*d* extending downwardly and flaring outwardly, a lower vertical wall section 12*e* extending downwardly from the lower tapered wall section 12*d*, and a planar horizontal keel 12*f*. The upper tapered wall section 12*c* has a substantially greater vertical height than the lower tapered wall section 12*d*, and the upper vertical wall section 12*b* has a slightly greater vertical height than the lower vertical wall section 12*e*.

Figure 2:
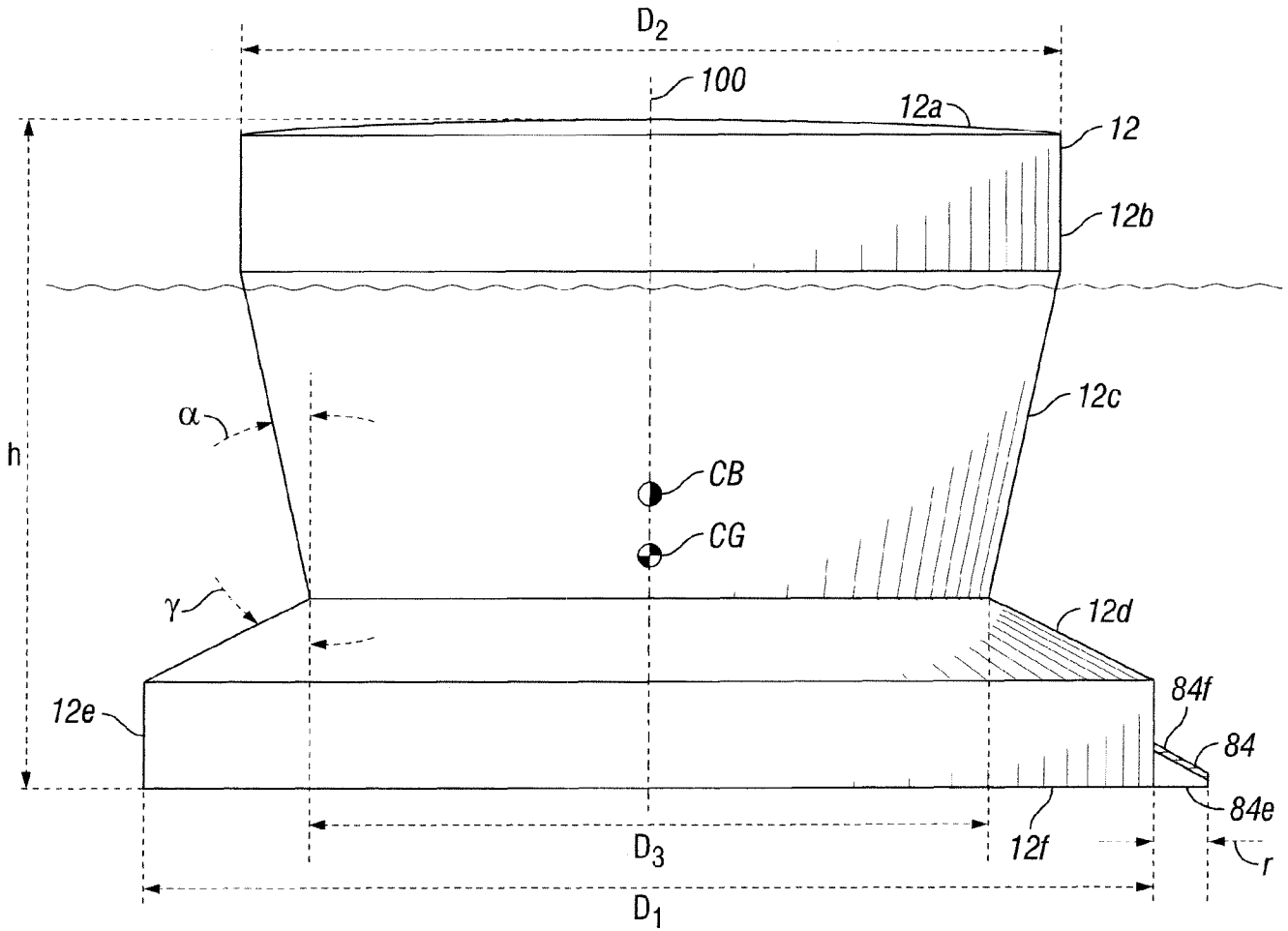
FIG. 2 is an axial cross-sectional drawing of the hull profile of the buoyant offshore storage structure according to an embodiment of the invention, showing an upper vertical wall portion, an upper inwardly tapered wall section, a lower outwardly tapered wall section, and a lower vertical wall section.

The main deck 12*a*, upper vertical wall section 12*b*, upper tapered wall section 12*c*, lower tapered wall section 12*d*, lower vertical wall section 12*e*, and keel 12*f* are all co-axial with a common vertical axis 100, which is shown in FIG. 2. Accordingly, the hull 12 is characterized by a circular cross section when taken perpendicular to the vertical axis 100 at any elevation.

Due to its circular platform, the dynamic response of the hull 12 is independent of wave direction (when neglecting any asymmetries in the mooring system, risers, and underwater appendages). Additionally, the conical form of the hull 12 is structurally efficient, offering a high payload and storage volume per ton of steel when compared to traditional ship-shaped offshore structures. The hull 12 has round walls which are circular in radial cross-section, but such shape can be approximated using a large number of flat metal plates rather than bending plates into a desired curvature.

Although a circular hull platform is shown, polygonal hull platforms can be used according to alternative embodiments, as described below with respect to FIG. 12. It is preferred, but not necessary, that the buoyant structure 10 be symmetric or nearly symmetric about the vertical axis 100 to minimize wave-induced yaw forces.

FIG. 2 is a simplified view of the vertical profile of hull 12 according to an embodiment of the invention. Such profile applies to both circular and polygonal hull platforms. The specific design of upper and lower tapered walls sections 12*c*, 12*d* generates a significant amount of radiation damping resulting in almost no heave amplification for any wave period, as described below.

Inward the upper tapered wall section 12*c* is located in the wave zone. At design draft, the waterline is located on the upper tapered wall section 12*c* just below the intersection with the upper vertical wall section 12*b*. The upper tapered wall section 12*c* slopes at an angle ($\alpha$) with respect to the vertical axis 100 from 10 degrees to 15 degrees. The inward flare before reaching the waterline significantly dampens downward heave, because a downward motion of the hull 12 increases the waterplane area. In other words, the hull area normal to the vertical axis 100 that breaks the water's surface will increase with downward hull motion, and such increased area is subject to the opposing resistance of the air/water interface. It has been found that from 10 degrees to 15 degrees of flare provides a desirable amount of damping of downward heave without sacrificing too much storage volume for the vessel.

Similarly, the lower tapered wall section 12*d* dampens upward heave. The lower the lower tapered wall section 12*d* is located below the wave zone (about 30 meters below the waterline). Because the entire lower tapered wall section 12*d* is below the water surface, a greater area (normal to the vertical axis 100) is desired to achieve upward damping. Accordingly, the diameter $D_1$ of the lower hull section is preferably greater than the diameter $D_2$ of the upper hull section. The lower tapered wall section 12*d* slopes at an angle ($\gamma$) with respect to the vertical axis 100 from 55 degrees to 65 degrees. The lower section flares outwardly at an angle greater than or equal to 55 degrees to provide greater inertia for heave roll and pitch motions. The increased mass contributes to natural periods for heave pitch and roll above the expected wave energy. The upper bound of 65 degrees is based on avoiding abrupt changes in stability during initial ballasting on installation. That is, the lower tapered wall section 12*d* can be perpendicular to the vertical axis 100 and achieve a desired amount of upward heave damping, but such a hull profile would result in an undesirable step-change in stability during initial ballasting on installation.

Figure 4:
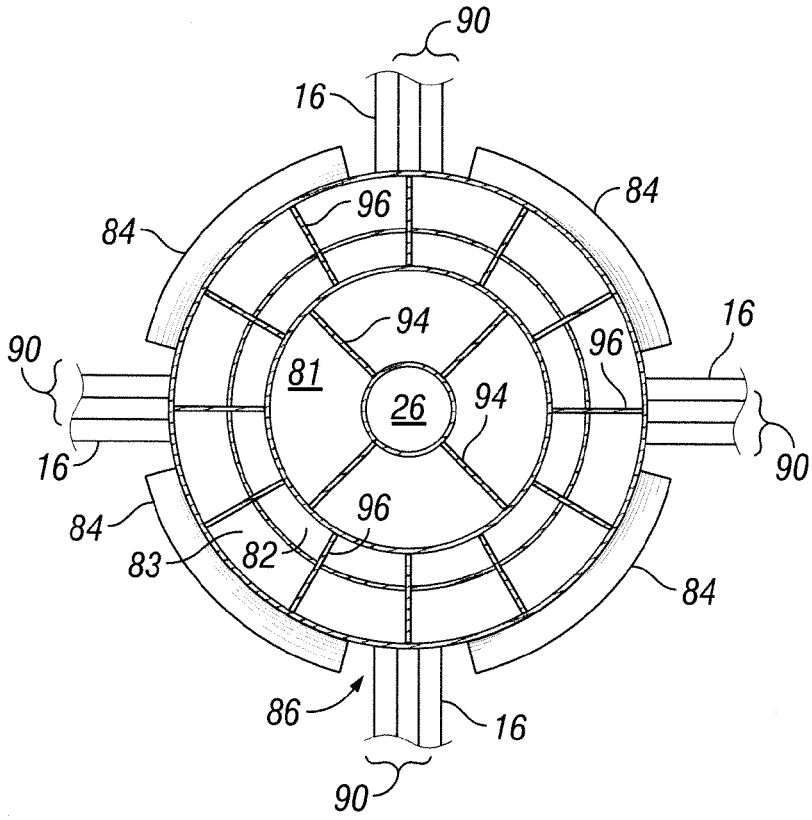
FIG. 4 is a radial cross-section of the hull of FIG. 3 taken along line 4-4, showing a plan view of the added mass fin-shaped appendages and internal hull compartmentalization.

As illustrated in FIG. 2, the center of gravity of the buoyant structure 10 is located below its center of buoyancy to provide inherent stability. The addition of ballast to the hull 12, as described below with respect to FIG. 3 and FIG. 4, is used to lower the CG. Ideally, enough ballast is added to lower the CG below the CB for whatever superstructure 13 in FIG. 1 configuration and payload is to be carried by the hull 12.

The hull form of buoyant structure 10 is characterized by a relatively high metacenter. But, because the CG is low, the metacentric height is further enhanced, resulting in large righting moments. Additionally, the peripheral location of the fixed ballast (discussed below with respect to FIG. 3 and FIG. 4), further increases the righting moments. Accordingly, the buoyant structure 10 aggressively resists roll and pitch and is said to be "stiff." Stiff vessels are typically characterized by abrupt jerky accelerations as the large righting moments counter pitch and roll. However, the inertia associated with the high total mass of the buoyant structure 10, enhanced specifically by the fixed ballast, mitigates such accelerations. In particular, the mass of the fixed ballast increases the natural period of the buoyant structure 10 to above the period of the most common waves, thereby limiting wave-induced acceleration in all degrees of freedom.

FIG. 3 and FIG. 4 show one possible arrangement of ballast and storage compartments within the hull 12. One or more compartments 80 together forming a ring shape (having a square or rectangular cross-section) are located in a lowermost and outermost portion of the hull 12. The one or more compartments 80 are reserved for fixed ballasting to lower the CG of the buoyant structure 10. A heavy ballast, such as concrete loaded with a heavy aggregate of hematite, barite, limonite, magnetite, steel punchings, shot, swarf, other scrap, or the like, can be used. However, more preferably, a slurry of hematite and water, for example, one part hematite to three parts of water, is used. The heavy slurry of hematite and water provides advantages of high density structural ballast with the ease and flexibility of removal by pumping, should the need arise.

The hull 12 includes other ring-shaped compartments for use as voids, ballasting, or hydrocarbon storage. One or more compartments 81 can surround the optional moon pool 26 and includes one or more radial bulkheads 94 for structural support and either compartmentalization or baffling. Two outer, annular tanks and/or compartments having outside walls conforming to the shape of the outer walls of the hull 12 surround the one or more compartments 81. Compartments 82 and 83 include radial bulkheads 96 for structural support and compartmentalization, thereby allowing for fine trim adjustment by adjusting tank levels.

FIG. 3 and FIG. 4 also show detail of optional fin-shaped appendages 84 used for creating added mass and for reducing heave and otherwise steadying the buoyant structure 10. The one or more fin-shaped appendages 84 are attached to a lower and outer portion of the lower vertical wall section 12*e* of the hull 12. As shown, the fin-shaped appendages 84 can comprise four fin sections separated from each other by gaps 86. The gaps 86 accommodate catenary production risers 90 and anchor lines 16 on the exterior of hull 12 without contact with the fin-shaped appendages 84.

Referring back to FIG. 2, a fin-shaped appendage 84 for reducing heave is shown in cross-section. The a fin-shaped appendage 84 can have the shape of a right triangle in a vertical cross-section, where the right angle is located adjacent a lowermost outer side wall of the lower vertical wall section 12*e* of the hull 12, such that a bottom edge 84*e* of the triangle shape is co-planar with the keel 12*f*, and the hypotenuse 84*f* of the triangle shape extends from a distal end of the bottom edge 84*e* of the triangle shape upwards and inwards to attach to the outer side wall of the lower vertical wall section 12*e*.

The number, size, and orientation of the fin-shaped appendage 84 can be varied for optimum effectiveness in suppressing heave. For example, the bottom edge 84*e* can extend radially outward a distance that is about half the vertical height of the lower vertical wall section 12*e*, with the hypotenuse 84*f* attaching to the lower vertical wall section 12*e* about one quarter up the vertical height of the lower vertical wall section 12*e* from keel level. Alternatively, with the radius R of the lower vertical wall section 12*e* defined as $D_1/2$, then the bottom edge 84*e* of the fin-shaped appendage 84 can extend radially outwardly an additional distance r, where $0.05R \geq r \geq 0.20R$, preferably about $0.10R \geq r \geq 0.15R$, and more preferably $r \approx 0.125R$. Although four a fin-shaped appendages 84 of a particular configuration defining a given radial coverage are shown in FIG. 3 and FIG. 4, a different number of fins and fin-shaped appendages defining more or less radial coverage can be used to vary the amount of added mass as required. Added mass may or may not be desirable depending upon the requirements of a particular floating structure. Added mass, however, is generally the least expensive method of increasing the mass of a floating structure for purposes of influencing the natural period of motion.

In an embodiment, the buoyant structure 10 has a diameter $D_1$ of 121 m, $D_2$ of 97.6 m, and $D_3$ of 81 m, a height (h) 79.7 m, a draft of 59.4 m, a displacement of 452,863 metric tons, and a storage capacity of 1.6 MBbls. Such structure is characterized by a heave natural period of 23 s and a roll natural period of 32 s. However, the buoyant structure 10 can be designed and sized to meet the requirements of any particular application. For example, the above dimensions can be scaled using the well-known Froude scaling technique. For example, a scaled down offshore structure can have a diameter $D_2$ of 61 m, a draft of 37 m, a displacement of 110,562 metric tons, a heave natural period of 18 s and a roll natural period of 25 s.

It is desired that the height (h) of the hull 12 be limited to a dimension that allows the buoyant structure 10 to be assembled onshore or quayside using conventional shipbuilding methods and towed upright to an offshore location. Once installed, anchor lines 16, shown in FIG. 1, are fastened to anchors in the seabed, thereby mooring the buoyant structure 10 in a desired location.

Figure 5:
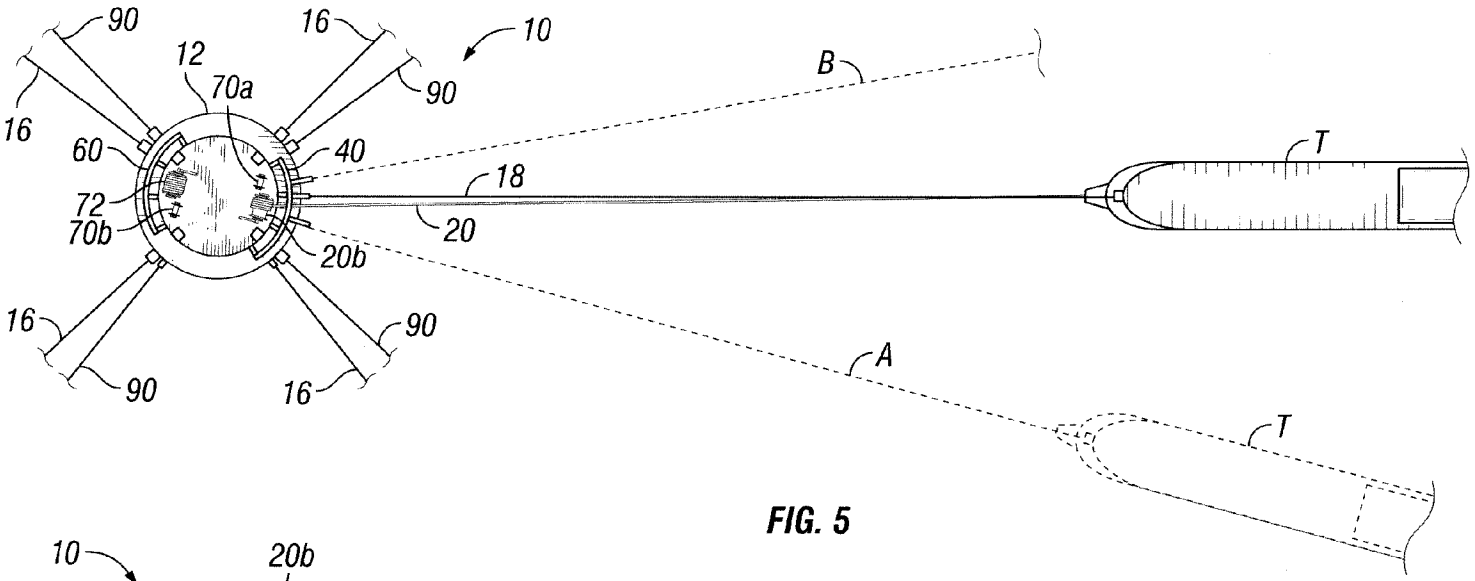
FIG. 5 is a simplified plan view of the storage structure of FIG. 1 with the drilling superstructure of the storage structure removed to reveal enlarged details of a movable hawser and offloading system, showing (in phantom lines) the tanker vessel of FIG. 1 freely weathervaning about the storage structure.
Figure 6:
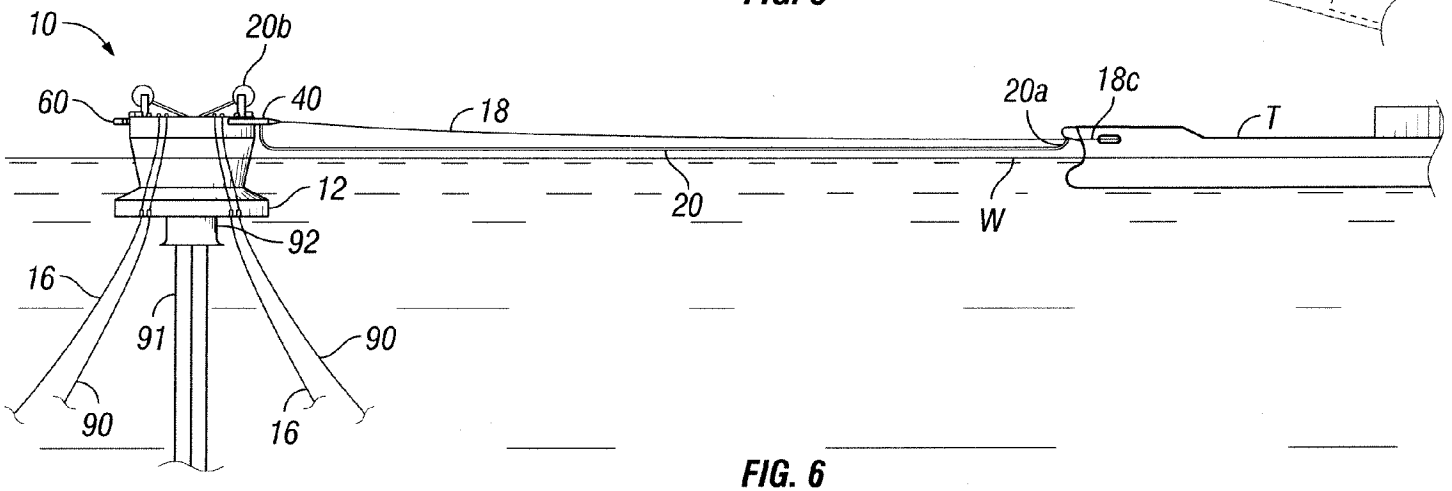
FIG. 6 is an elevation of the storage structure and tanker vessel of FIG. 5 showing catenary anchor mooring lines, optional production risers extending vertically to the center keel of the structure and being received within a riser landing porch, and optional catenary risers disposed radially about the structure hull.
Figure 7:
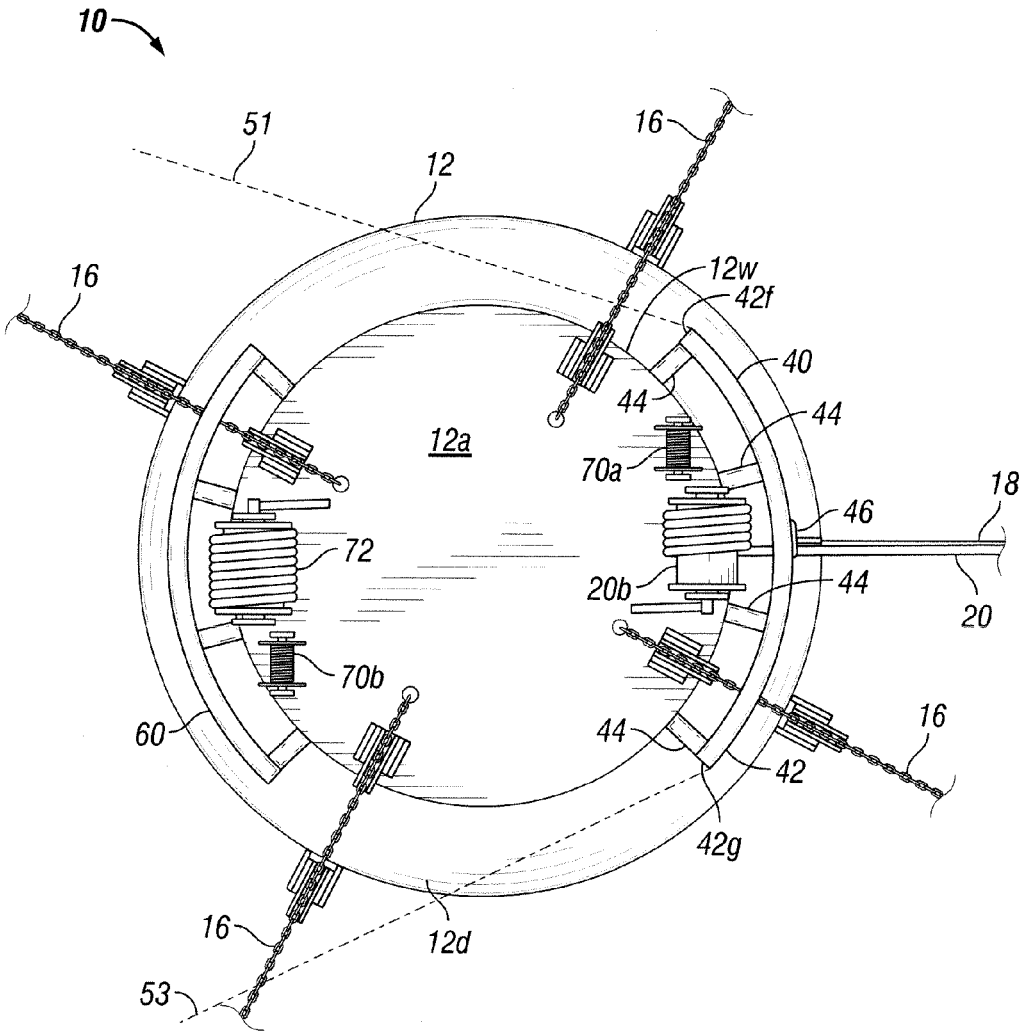
FIG. 7 is an enlarged and detailed plan view of the offshore storage structure of FIG. 5, showing a movable hawser and offloading system according to an embodiment of the invention.
Figure 8:
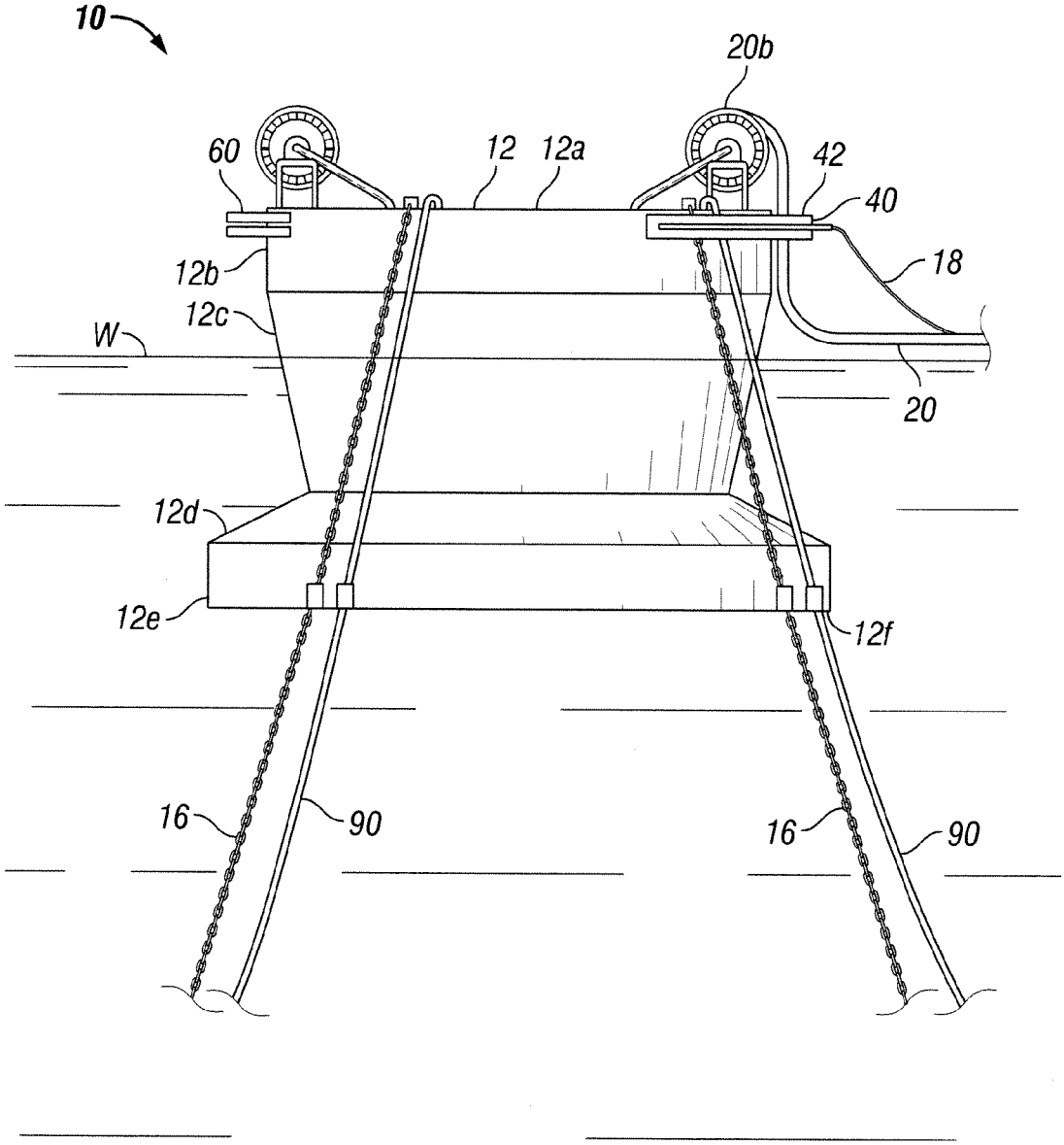
FIG. 8 is a detailed elevation drawing of the offshore storage structure of FIG. 7.

The buoyant structure 10 of FIG. 1 shown in plan view in FIG. 5 and FIG. 7 and in side elevation in FIG. 6 and FIG. 8. In a typical application, crude oil is produced from a subsea well (not illustrated), transferred into and stored temporarily in the hull 12, and later offloaded to a tanker vessel (T) for further transport to onshore facilities. The tanker vessel (T) is moored temporarily to the buoyant structure 10 during the offloading operation by a hawser 18, which is typically synthetic or wire rope. A hose 20 is extended between the hull 12 and the tanker vessel (T) for transfer of well fluids from the buoyant structure 10 to tanker vessel (T).

One procedure for mooring the tanker vessel (T) to the buoyant structure 10 is now described in greater detail. To offload a fluid cargo that has been stored in the buoyant structure 10, the tanker vessel (T) is brought near the buoyant structure. With reference to FIGS. 5-8, a messenger line is stored on reels 70*a* and/or 70*b*. A first end of a messenger line is shot with a pyrotechnic gun from the buoyant structure 10 to the tanker vessel (T) and received by personnel on the tanker vessel (T). The other end of the messenger is attached to a tanker end 18*c* of the hawser 18. The personnel on the tanker can pull hawser end 18*c* of the hawser 18 to the tanker vessel (T), where it is attached to a padeye, bits or other hard point on the tanker vessel (T). The personnel on the tanker vessel (T) then shoot one end of a messenger line to personnel on the buoyant structure 10, who hook that end of the messenger to a tanker end 20*a* of hose 20. Personnel on the tanker then pull hose 20 to the tanker and connect it to a fluid port on the cargo transfer system. Typically, cargo will be offloaded from the buoyant structure 10 to tanker vessel (T), but the opposite can also be done, where cargo from the tanker vessel (T) is transferred to the buoyant structure for storage.

During offloading operations, the tanker vessel (T) will weathervane about the buoyant structure 10 according to the vagaries of the surrounding environment. As described in greater detail below, weathervaning is accommodated on the buoyant structure 10 through the moveable hawser connection 40, which allowing considerable movement of the tanker about the buoyant structure 10 without interrupting the offloading operation.

After completion of an offloading operation, the hose end 20*a* is disconnected from the tanker vessel (T), and a hose reel 20*b* is used to reel hose 20 back into stowage on the buoyant structure 10. A second hose and hose reel 72 is ideally provided on the buoyant structure 10 for use in conjunction with the second moveable hawser connection 60 on the opposite side of the buoyant structure 10. The tanker end 18*c* of the hawser 18 is then disconnected, allowing the tanker vessel (T) to depart. The messenger line is used to pull the tanker end 18*c* of the hawser 18 back to the buoyant structure.

The location and orientation of the tanker vessel (T) is affected by wind direction and force, wave action and force and direction of current. Because its bow is moored to the buoyant structure 10 while its stem swings freely, the tanker vessel (T) weathervanes about the buoyant structure 10. As depicted in FIG. 5, forces due to wind, wave and current change, the tanker vessel (T) can move to the position indicated by phantom line A or to the position indicated by phantom line B. Tugboats or an additional temporary anchoring system, neither of which is shown, can be used to keep the tanker vessel (T) a minimum, safe distance from the buoyant structure 10 in case of a change in net forces that would otherwise cause the tanker vessel (T) to move toward the buoyant structure 10.

As best seen in FIG. 7, the movable hawser connection 40 can include an arcuate track or rail 42. A trolley 46 rides on the arcuate rail or track 42 provides a movable mooring padeye or hard point to which the hawser 18 connects, thus allowing weathervaning of the tanker vessel (T). In one embodiment, the arcuate rail or track 42 extends in a 90-degree arc about the hull 12, thus allowing unfettered weathervaning in an approximate 270 degree arc between lines 51 and 53. The arcuate rail or track 42 has closed opposing ends 42*f* and 42*g* for providing stops for the trolley 46. The arcuate rail or track 42 has a radius of curvature that exceeds and parallels the radius of curvature of outside the upper vertical wall section 12*b* of the hull 12. Standoffs 44 space the arcuate rail or track away from the upper vertical wall section 12*b* of the hull 12. Hose 20, anchor line 16, and risers 90 can pass through a space defined between the upper vertical wall section 12*b* and the arcuate rail or track 42. In one or more embodiments, the arcuate rail or track can be a tubular channel.

For flexibility in accommodating wind direction, the buoyant structure 10 has a second moveable hawser connection 60 positioned opposite of the moveable hawser connection 40. The tanker vessel (T) can be moored to either moveable hawser connection 40 or to the second moveable hawser connection 60, depending on which better accommodates the tanker vessel (T) downwind of the buoyant structure 10. The second moveable hawser connection 60 is essentially identical in design and construction to moveable hawser 40 with its own slotted arcuate rail or track and trapped, free-rolling trolley car having a shackle protruding through the slot in the arcuate rail or track. Because each moveable hawser connection 40 and 60 is capable of accommodating movement of the tanker vessel (T) within about a 270-degree arc, a great deal of flexibility is provided for offloading operation with 360 degrees of weathervane capability. However, a different number of movable hawser connections covering various arcs can be provided. For example, a single hawser connection covering 360 degrees is within the scope of the invention.

Figure 9:
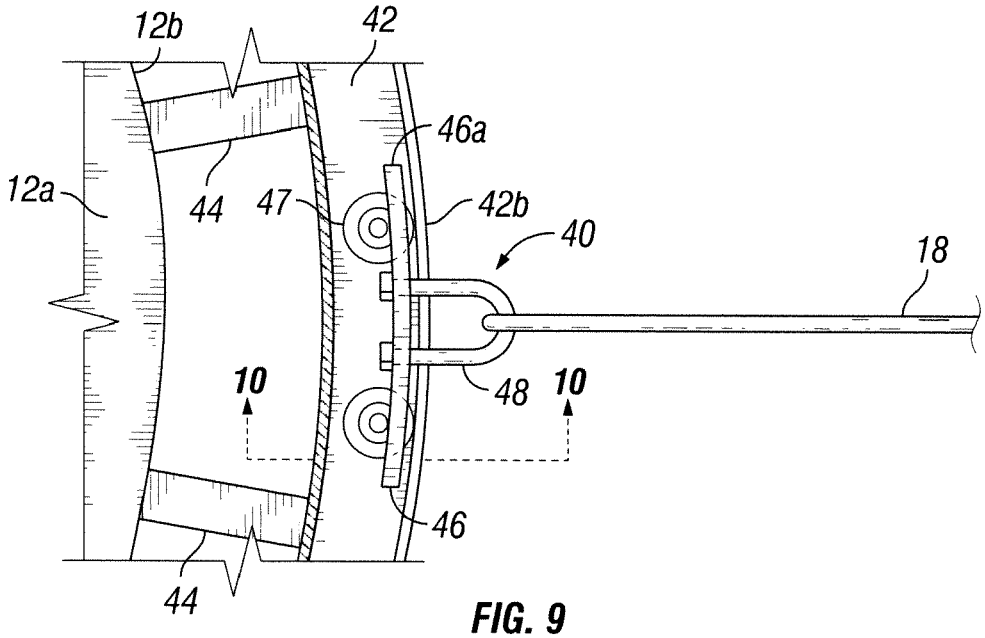
FIG. 9 is a detailed plan view of one of the moveable hawser connections illustrated in FIG. 7.
Figure 10:
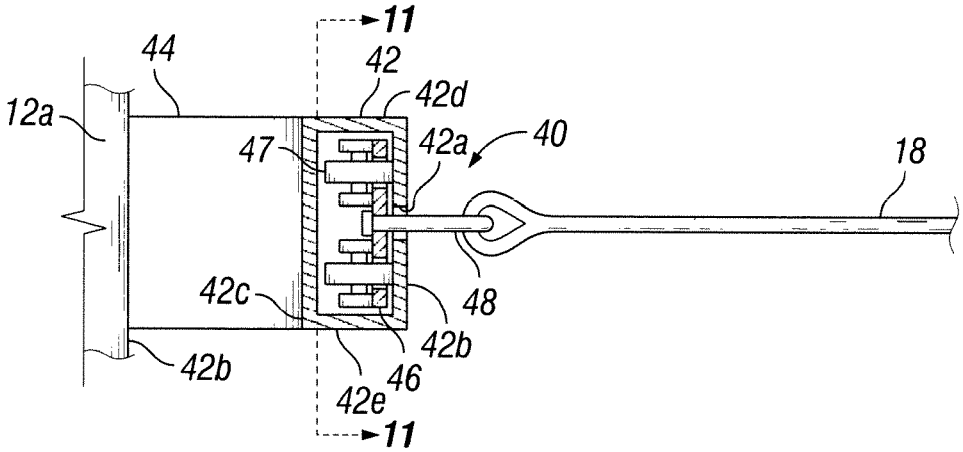
FIG. 10 is a detailed side view elevation in partial cross-section as seen along line 10-10 of the moveable hawser connection of FIG. 9.
Figure 11:
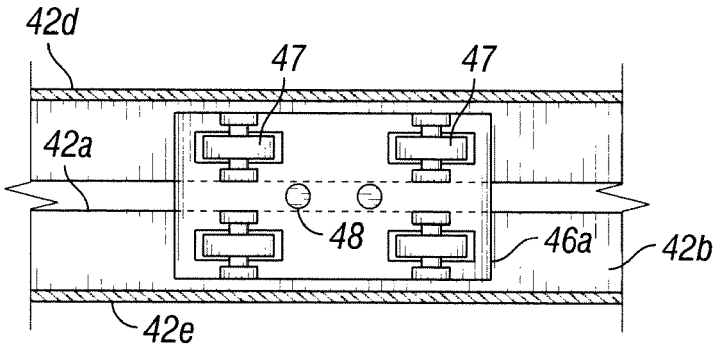
FIG. 11 is a detailed front view elevation in partial cross-section taken along line 11-11 of FIG. 10 of the moveable hawser connection of FIG. 9.

FIGS. 9-11 illustrate a moveable hawser connection 40 in detail according to the present invention. Moveable hawser connection 40 includes a nearly fully enclosed the arcuate rail or track 42 that has a rectangular cross-section and a longitudinal slot 42*a* on the outboard side wall 42*b*. Standoffs 44 mount the arcuate rail or track 42 horizontally to the upper vertical wall section 12*b* of the hull 12. The trolley 46 is captured by and moveable within the arcuate rail or track 42. A trolley shackle or padeye 48 is attached to the trolley 46 and provides a hard connection point for the hawser 18. As shipboard rigging is well known in the art, details of the hawser connection are not provided herein. Wall 42*b*, which has slot 42*a*, is a relatively tall, vertical outer wall, and an outside surface of an opposing inner wall 42*c* is equal in height. Standoffs 44 are attached, such as by welding, to the outside surface of inner wall 42*c*. A pair of opposing, relatively short, horizontal walls 42*d* and 42*e* extend between vertical walls 42*b* and 42*c* to complete the enclosure of the arcuate rail or track 42, except vertical wall 42*b* has the horizontal, longitudinal slot 42*a* that extends nearly the full length of the arcuate rail or track 42. The trolley 46 includes a base plate 46*a*, which has four rectangular openings formed therethrough for receiving four wheels 47. The trolley 46 is free to roll back and forth within the enclosed arcuate rail or track 42 between ends 42*f* and 42*g*.

Wind, wave and current action can apply a great deal of force on the tanker vessel (T), particularly during a storm or squall, which in turn applies a great deal of force on the trolley 46 and the arcuate rail or track 42. Slot 42*a* weakens the arcuate rail or track 42, and if enough force is applied, wall 42*b* can bend, possibly opening slot 42*a* wide enough for the trolley 46 to be ripped out of its track. The arcuate rail or track 42 is therefore designed and built to withstand such forces. Inside corners within the arcuate rail or track 42 are ideally reinforced.

The arcuate rail or track 42 described and illustrated in FIGS. 9-11 is just one arrangement for providing a moveable hawser connection 40. Any type of rail, channel or track can be used in the moveable hawser connection, provided a trolley or any kind of rolling, moveable or sliding device can move longitudinally but is otherwise trapped by the rail, channel or track. For example, an I-beam, which has opposing flanges attached to a central web, may be used as a rail instead of the arcuate rail or track, with a trolley car or other rolling or sliding device captured and moveable on the I-beam.

Figure 12:
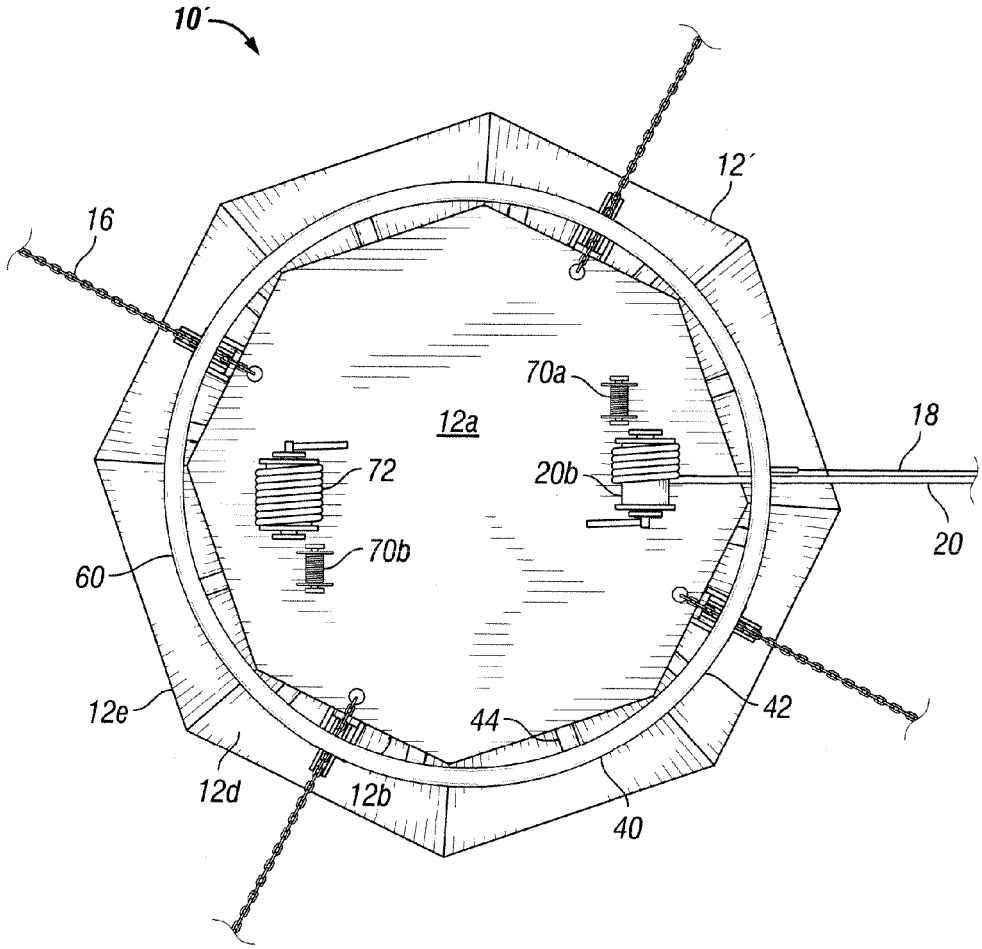
FIG. 12 is a simplified plan view of the offshore storage structure of FIG. 1 according to an alternate embodiment of the invention, showing a hexagonal hull platform and a 360 degree movable hawser connection.

FIG. 12 illustrates the buoyant structure 10 having a hull 12 of a polygonal platform. One or more arcuate channels or rails 42 with an appropriate radius of curvature is mounted to the hull 12 with appropriate standoffs 44 so as to provide the moveable hawser connection 40. FIG. 12 illustrates a hexagonal hull, but any number of sides can be used as appropriate.

While these embodiments have been described with emphasis on the embodiments, it should be understood that within the scope of the appended claims, the embodiments might be practiced other than as specifically described herein.

What is claimed is:

1. A buoyant structure for petroleum drilling, production, storage and offloading, comprising:

a. a hull symmetric about a vertical axis and having a circular platform and a vertical profile designed to extend below and above a sea surface simultaneously, the hull including:
   i. an upper vertical wall section;
   ii. an upper tapered wall section having a gentle inward slope;
   iii. a lower tapered wall section having a steep outward slope; and
   iv. a lower vertical wall section with the conical form of the hull being structurally efficient, offering a high payload and storage volume per ton of material used to build the hull;

b. a planar horizontal keel of a lower hull diameter and a generally horizontal main deck;

c. a plurality of fin-shaped appendages attached to a lower and outer portion of the lower vertical wall section of the hull; each fin-shaped section comprising: a plurality of fin sections separated from each other by gaps and the gaps adapted to accommodate catenary production risers and anchor lines on the exterior of hull without contact with the fin-shaped appendages;

d. a low center of gravity (CG) located below its center of buoyancy (CB) thereby providing inherent stability with the low center of gravity (CG) enhancing a meta centric height of the buoyant structure resulting in a large righting movement; and e. ballasting in one or more ring-shaped lower compartments with a heavy slurry with the compartments forming a ring shape and located in outer-most portions of the lower vertical wall section providing the advantages of high density structural ballast with the ease and flexibility of removal by pumping the heavy slurry material creates large righting moments and increases the natural period of the structure to above the period of the most common waves, thereby limiting wave-induced acceleration in all degrees of freedom, and thereby further increasing the large righting movement.

2. The buoyant structure of claim 1, wherein the upper tapered wall section slopes at a first angle with respect to the vertical axis from 10 degrees to 15 degrees; and the lower tapered wall section slopes at a second angle with respect to the vertical axis from 55 degrees to 65 degrees.

3. The buoyant structure of claim 1, wherein the upper vertical wall section abuts the upper tapered wall section, the lower vertical wall section abuts the lower tapered wall section, and the upper tapered wall section abuts the lower tapered wall section at a diameter.

4. The buoyant structure of claim 1, wherein a height of the hull defined from the planar horizontal keel to the generally horizontal main deck is less than the largest diameter of the hull.

5. The buoyant structure of claim 1, wherein a height of the hull, defined from the planar horizontal keel to the generally horizontal main deck is less than the smallest diameter of the hull.

6. The buoyant structure of claim 1, wherein the upper vertical wall section defines an upper hull diameter; the bottom of the upper tapered wall section defines a hull neck diameter; the hull neck diameter is from 75 percent to 90 percent of the upper hull diameter and the lower hull diameter is from 115 percent to 130 percent of the upper hull diameter.

7. The buoyant structure of claim 6, wherein the hull neck diameter is from 80 percent to 85 percent of the upper hull diameter and the lower hull diameter is from 120 percent to 125 percent of the upper hull diameter.

8. The buoyant structure of claim 1, wherein the buoyant structure defines a center of gravity and a center of buoyancy; and the center of gravity is located below the center of buoyancy.

9. The buoyant structure of claim 1, further comprising one or more compartments forming a ring shape disposed in a lowermost outermost portion of the hull, and ballast disposed in the one or more compartments.

10. The buoyant structure of claim 1, further comprising:

a. a first moveable hawser connection including a first arcuate rail or track mounted to an upper outer wall of the hull and a first trolley captured by and movably disposed on the first arcuate rail or track, the first trolley defining a first movable hard point; and b. a vessel moored to the first movable hard point.

11. The buoyant structure of claim 10, wherein the first arcuate rail or track is circular and disposed 360 degrees about the hull.

12. The buoyant structure of claim 10, further comprising a second moveable hawser connection including a second arcuate rail mounted to an upper outer wall of the hull opposite the first arcuate rail and a second trolley captured by and movably disposed on the second rail, the second trolley defining a second movable hard point for mooring a vessel thereto.

13. The buoyant structure of claim 12, wherein the first arcuate rail defines a first center point located on the vertical axis; the second arcuate rail defines a second center point located on the vertical axis; the first arcuate rail defines a first arc extending approximately 90 degrees about the first center point; the second arcuate rail defines a second arc extending approximately 90 degrees about the second center point and approximately 180 degrees opposite the first arcuate rail; whereby each of the first and second movable hawser connections allows a vessel moored thereto to weathervane approximately 270 degrees about the buoyant structure.

14. The buoyant structure of claim 1, further comprising a non-curing slurry added to the heavy material.

15. The buoyant structure of claim 14, further comprising as the heavy material and non-curing slurry: water with at least one from a group consisting of hematite, barite, limonite, magnetite and combinations thereof.

16. The buoyant structure of claim 15, further comprising as the non-curing slurry: about three parts water to one part hematite.

* * * * *